US009482981B2

(12) United States Patent
Kato et al.

(10) Patent No.: US 9,482,981 B2
(45) Date of Patent: Nov. 1, 2016

(54) IMAGE FORMING APPARATUS

(71) Applicant: KONICA MINOLTA, INC., Chiyoda-ku, Tokyo (JP)

(72) Inventors: Tomohiro Kato, Okazaki (JP); Kazuki Kobori, Toyokawa (JP); Hirohisa Shirai, Toyokawa (JP); Hisashi Murata, Toyohashi (JP); Masato Kimura, Toyoake (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/049,423

(22) Filed: Feb. 22, 2016

(65) Prior Publication Data

US 2016/0252838 A1 Sep. 1, 2016

(30) Foreign Application Priority Data

Feb. 26, 2015 (JP) ..... 2015-036271

(51) Int. Cl.
*G03G 15/02* (2006.01)
*G03G 21/20* (2006.01)

(52) U.S. Cl.
CPC ..... *G03G 15/0266* (2013.01); *G03G 21/20* (2013.01)

(58) Field of Classification Search
USPC ..... 399/38, 42, 44, 50, 91–100
See application file for complete search history.

(56) References Cited

U.S. PATENT DOCUMENTS 6,829,444 B2 * 12/2004 Ashikawa ..... G03G 15/0216 399/44
7,630,659 B2 * 12/2009 Uchitani ..... G03G 15/5037 399/44
7,899,352 B2 * 3/2011 Tomiie ..... G03G 15/0266 399/174

FOREIGN PATENT DOCUMENTS

JP 2014085405 A 5/2014

* cited by examiner

*Primary Examiner* — Hoan Tran
(74) *Attorney, Agent, or Firm* — Holtz, Holtz & Volek PC

(57) ABSTRACT

An image forming apparatus has: an image supporting member; a charger in proximity to the image supporting member; a power source unit configured to apply charging voltages to the charger sequentially, the charging voltages including alternating voltages having different peak-to-peak voltages, respectively; an amperometric detector configured to detect values of alternating currents flowing in the charger during application of the charging voltages; and a processor configured to carry out a first charging voltage determination process or a second charging voltage determination process requiring a shorter time than the first charging voltage determination process selectively based on a detection result of the amperometric detector. The processor carries out the first charging voltage determination process or the second charging voltage determination process selectively in accordance with a difference between an ambient temperature at a previous time of carrying out the first charging voltage determination process and a current ambient temperature.

7 Claims, 11 Drawing Sheets

IMAGE FORMING APPARATUS

The present invention claims benefit of priority to Japanese Patent Application No. 2015-036271 filed Feb. 26, 2015, the content of which is incorporated herein by reference.

BACKGROUND OF THE INVENTION

1. Field of the Invention

The present invention relates to an image forming apparatus comprising a proximity charger to be impressed with a superimposed voltage of a DC voltage and an AC voltage.

2. Description of Related Art

Recently, for charging in an image forming apparatus, a proximity charging method is mainly adopted. In the proximity charging method, for example, a roller-type charger is provided in proximity to the surface of a photoreceptor drum so as to be in contact or out of contact with the surface of the photoreceptor drum. A superimposed voltage of a DC voltage and an AC voltage is applied to the charger so that the charger can charge the surface of the photoreceptor drum uniformly.

It is known that the charged potential Vs of the surface of the photoreceptor drum and the peak-to-peak voltage Vpp of the AC voltage Vac have a relationship as illustrated in FIG. 11. While the peak-to-peak voltage Vpp is within a range from a charging start voltage Vth to a voltage 2×Vth, the charged potential Vs is substantially proportional to the AC voltage Vac. Here, the charging start voltage value Vth is a voltage value that permits the charger to start charging the photoreceptor drum, and the voltage value Vth is defined by the DC voltage Vdc. The charging start voltage Vth is determined depending on the characteristics of the photoreceptor drum and other factors. In the case of FIG. 11, the voltage value Vth is 800V, and the voltage value 2×Vth is 1600V.

After the peak-to-peak voltage Vpp becomes above the value 2×Vth, the charged potential Vs of the surface of the photoreceptor drum is saturated and substantially kept constant at Vs0. Therefore, in order to charge the surface of the photoreceptor drum to have a uniform charged potential Vs, it is necessary to apply a superimposed voltage obtained by superimposing an AC voltage Vac having a peak-to-peak voltage Vpp greater than 2×Vth on a DC voltage Vdc to the charger. In this regard, the charged potential Vs0 depends on the DC voltage Vdc of the superimposed voltage.

Meanwhile, in an image forming apparatus, the amount of discharge from a charger is required to be constant regardless of changes in environmental conditions, variations in the resistance of the charger due to manufacturing errors, etc. so as to charge a photoreceptor drum uniformly without causing deterioration of the photoreceptor drum, poor-quality image formation, etc. For this purpose, conventionally, an image forming apparatus comprises a measuring device that measures the alternating current flowing in the charger via the photoreceptor drum, and a controller.

The measuring device measures values of the alternating current while no sheets are fed in the image forming apparatus. Specifically, the measuring device measures values of the alternating current flowing in the charger when alternating voltages Vac having different peak-to-peak voltages Vpp respectively, all of which are less than 2×Vth, are applied to the charger sequentially. In a similar way, the measuring device determines the values of alternating current flowing in the charger when alternating voltages Vac having different peak-to-peak voltages Vpp respectively, all of which are equal to or greater than 2×Vth, are applied to the charger. In this specification, a range in which the peak-to-peak voltage Vpp is less than 2×Vth is referred to as a forward discharge range, in which charge transfers only from the charger to the photoreceptor drum (that is, mono-directional charge transfer occurs), and a range in which the peak-to-peak voltage Vpp is equal to or greater than 2×Vth is referred to as a reverse discharge range, in which charge transfers from the charger to the photoreceptor drum and from the photoreceptor drum to the charger alternately (that is, bi-directional charge transfer between the charger and the photoreceptor drum occurs).

From the values of the alternating current collected by the measuring device, the controller determines a peak-to-peak voltage Vppi of the alternating voltage Vaci to be used as a component of the charging voltage in a printing process. In this specification, such a control process is referred to as a first charging voltage determination process.

A specific example of the first charging voltage determination process will hereinafter be described with reference to FIG. 12. The controller obtains values Iac1-Iac3 of the alternating current flowing in the charger when AC voltages Vac1-Vac3 are applied to the charger in the forward discharge range, and from the alternating current values Iac1-Iac3, the controller derives characteristic line L1 indicating alternating current values with respect to the applied alternating voltage in the forward discharge range by direct approximation. In a similar way, the controller derives a characteristic line L2 indicating alternating current values with respect to the applied alternating voltage in the reverse discharge range. The controller determines the point of intersection between the characteristic lines L1 and L2 as the alternating voltage Vaci to be used as a component of a superimposed charging voltage in a printing process.

When the alternating current value Iac is determined by the first charging voltage determination process, non-uniformity of the film thickness of the photoreceptor drum is taken into consideration in some cases. More specifically, while the photoreceptor drum is rotated once, the controller obtains the alternating current values Iac at a predetermined number of places different from each other in the circumferential direction. The controller determines the average of the measured alternating current values Iac as the alternating current value Iac achieved by application of the alternating voltage Vac to the charger.

During the first charging voltage determination process, alternating voltages Vac having different peak-to-peak voltages Vpp are applied to the charger sequentially, and accordingly, the surface of the photoreceptor drum is covered with toner while rotating. The toner moves to a second transfer roller via an intermediate transfer belt, which causes contamination of the second transfer roller. For this reason, after the first charging voltage determination process, cleaning of the second transfer roller is carried out.

Not a little time is needed from the start of the first charging voltage determination process to the end of the cleaning. This time depends on the productivity and the system speed of the image forming apparatus. For example, when the system speed is 165 mm/sec., the time is about 20 seconds.

If the peak-to-peak voltage Vpp of the alternating voltage Vaci is too small, it results in poor-quality image formation. On the other hand, if the peak-to-peak voltage Vpp of the alternating voltage Vaci is too great, it accelerates abrasion of the photoreceptor drum. Therefore, the first charging voltage determination process is preferably carried out not only for a printing process but also for other processes that require driving of the photoreceptor drum. The processes that require driving of the photoreceptor drum are, for example, an image stabilization process at the time of warm-up, a forced toner resupply process, a TCR (toner-to-carrier ratio) adjustment process, etc. If the first charging voltage determination process is carried out for these processes, it will keep users waiting for a long time. Therefore, for example, according to Japanese Patent Laid-Open Publication No. 2014-085405, the time needed for the first charging voltage determination process is shortened by comparing the ambient temperature at the previous time of carrying out the first charging voltage determination process with the current ambient temperature and by changing the peak-to-peak voltage Vpp of the alternating voltage to be used first in the current first charging voltage determination process depending on the comparison result.

According to Japanese Patent Laid-Open Publication No. 2014-085405, adjustment of the alternating voltage Vac is started with the voltage determined by the previous first charging voltage determination process or the voltage predetermined for the environmental conditions applied first. According to Japanese Patent Laid-Open Publication No. 2014-085405, although the first applied voltage for the alternating voltage adjustment is changed in accordance with changes in the environmental conditions, the method of determining the alternating voltage is the same regardless of the environmental conditions. Accordingly, it does not lead to significant shortening of the waiting time of users.

SUMMARY OF THE INVENTION

An object of the present invention is to provide an image forming apparatus that can shorten the waiting time of users at a time of determining a peak-to-peak voltage of a voltage to be used for various processes.

An embodiment of the present invention relates to an image forming apparatus capable of forming an image on a print medium while feeding the print medium, and the image forming apparatus comprises: an image supporting member; a charger provided in proximity to the image supporting member; a power source unit configured to apply a plurality of charging voltages to the charger sequentially while no print medium is fed, the charging voltages including alternating voltages having different peak-to-peak voltages, respectively; an amperometric detector configured to detect values of the alternating currents flowing in the charger during application of the plurality of charging voltages; and a processor configured to carry out a first charging voltage determination process to determine a peak-to-peak voltage to be used in a process, or a second charging voltage determination process to determine a peak-to-peak voltage to be used in the process selectively based on a detection result of the amperometric detector, the second charging voltage determination process requiring a shorter time to determine the peak-to-peak voltage than the first charging voltage determination process, wherein the processor carries out the first charging voltage determination process or the second charging voltage determination process selectively in accordance with a difference between an ambient temperature at a previous time of carrying out the first charging voltage determination process and a current ambient temperature.

DETAILED DESCRIPTION OF THE PREFERRED EMBODIMENTS

Some preferred embodiments of the present invention will hereinafter be described with reference to the drawings.

1. Definitions

In some of the drawings, x-direction, y-direction and z-direction that are perpendicular to one another are indicated. The x-direction and the z-direction indicate the right-left direction and the up-down direction of an image forming apparatus 1. The y-direction indicates the front-rear direction of the image forming apparatus 1.

2. General Structure of Image Forming Apparatus and Printing Process

Figure 1:
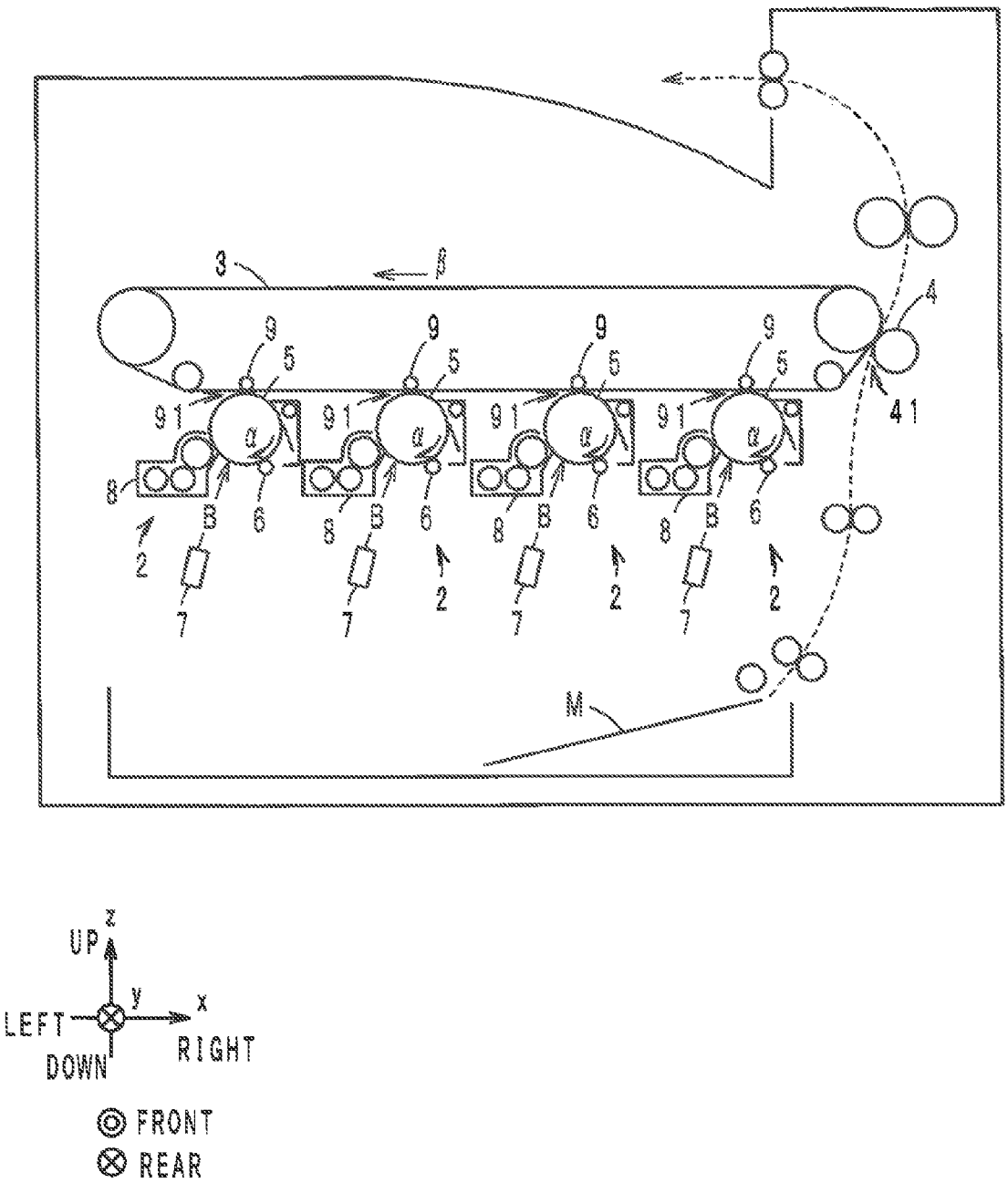
FIG. 1 is a skeleton framework of an image forming apparatus.
Figure 2:
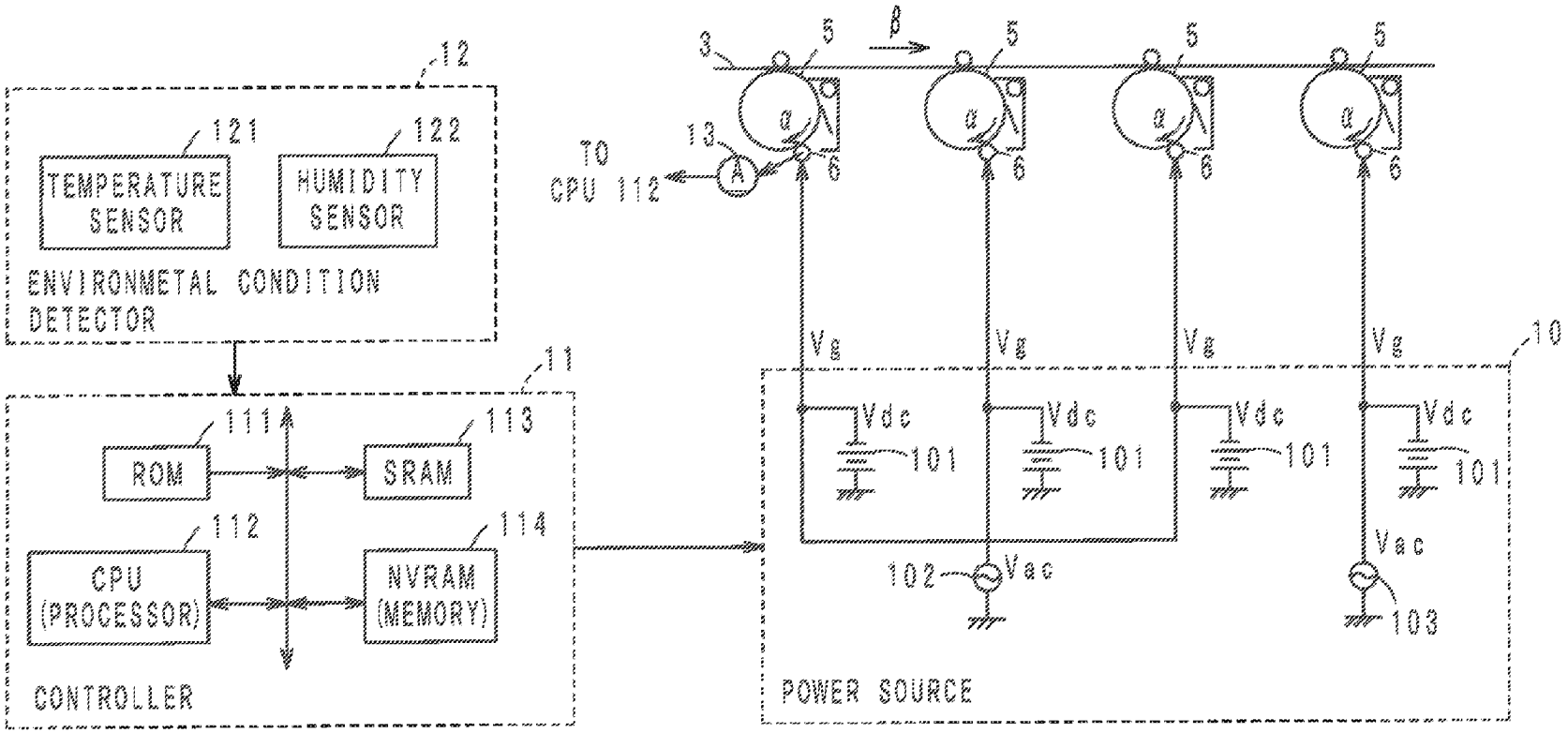
FIG. 2 is a configuration diagram of the main part of the image forming apparatus.

The image forming apparatus 1 illustrated in FIGS. 1 and 2 is, for example, a copying machine, a printer, a facsimile or a multifunction peripheral capable of functioning as these machines. The image forming apparatus 1 prints an image (typically, a full-color image or a monochromatic image) on a print medium (for example, a sheet of paper or an OHP sheet) M by an electrophotographic tandem method. For this purpose, the image forming apparatus 1 comprises image forming units 2 respectively for yellow (Y), magenta (M), cyan (C) and black (K), an intermediate transfer belt 3, a second transfer roller 4, a power source 10, a controller 11, an environmental condition detector 12, and at least one amperometric detector 13.

The image forming units 2 for the four colors are arranged side by side, for example, in the right-left direction, and each of the image forming units 2 includes a photoreceptor drum 5. The photoreceptor drum 5 is, for example, in the shape of a cylinder extending in the front-rear direction, and rotates on its own axis, for example, in the direction indicated by arrow $\alpha$.

Figure 3:
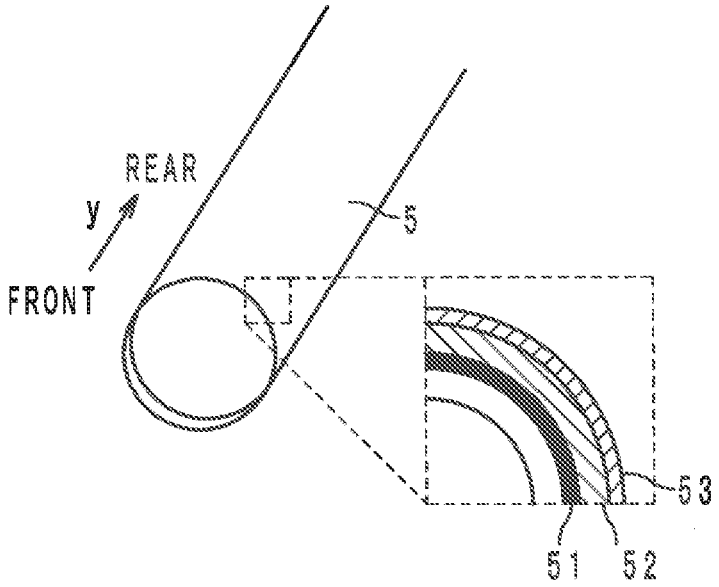
FIG. 3 is a diagram indicating a detailed structure of a photoreceptor drum illustrated in FIG. 1.

As illustrated in FIG. 3, the photoreceptor drum 5 is an organic photoreceptor having a charge generating layer (which will hereinafter be referred to as CGL) 51, a charge transfer layer (which will hereinafter be referred to as CTL)

52 and a protective layer (which will hereinafter be referred to as OCL) 53 stacked in this order on an aluminum base extending in the front-rear direction. The OCL 53 is not indispensable to the photoreceptor drum 5. Alternatively, the photoreceptor drum 5 may be an amorphous silicon photoreceptor (a-Si photoreceptor). Here, the amount of abrasion (μm) of the photoreceptor drum 5 every after 100000 rotations is defined as an index a indicating the abrasiveness of the surface of the photoreceptor drum 5. Table 1 below indicates the values a of various photoreceptor drums.

TABLE 1

| α of Various Photoreceptors | | | |
|---|---|---|---|
| | a-Si Photoreceptor | With OCL 53 | Without OCL 53 |
| α | 0.5 | 1.2 | 3.0 |

With reference to FIGS. 1 and 2 again, around each of the photoreceptor drums 5, at least a charger 6, a developing device 8 and a first transfer roller 9 are arranged in this order from upstream to downstream in the rotating direction a.

The charger 6 is typically a charging roller extending in the front-rear direction, and the charging roller is arranged in proximity to the corresponding photoreceptor drum 5 so as to be either in contact with or out of contact with the peripheral surface of the photoreceptor drum 5. The charger 6 is supplied with a voltage Vg by the power source 10, and electrifies the peripheral surface of the corresponding photoreceptor drum 5 uniformly while the photoreceptor drum 5 is rotating.

The power source 10 includes DC power circuits 101 for the respective colors, an AC power circuit 102 shared for two or more colors (for example, for the colors Y, M and C) and an AC power circuit 103 used for the other color(s) (for example, for the color K).

Each of the DC power circuits 101 outputs a predetermined DC voltage Vdc under control of the controller 11. Since the DC power circuits 101 are provided individually for the respective colors, it is possible to adjust the DC voltages for the respective colors separately. This embodiment, however, does not deal with differentiating the DC voltages for the respective colors from each other. Therefore, in the following paragraphs, for the convenience sake, all of the DC voltages Vdc for the colors will be described as having the same value.

Each of the AC power circuits 102 and 103 is, for example, an AC transformer, and outputs an AC voltage Vac having a variable peak-to-peak voltage Vpp under control of the controller 11. In the following paragraphs, the AC voltages Vac output from the AC power circuits 102 and 103 will be described as having the same value for the same reason as the DC voltages Vdc.

The output terminal of the AC power circuit 102 is connected to the respective output terminals of the DC power circuits 101 for the colors Y, M and C. Then, the alternating voltage Vac is superimposed on the DC voltages Vdc, and charging voltages Vg are generated. The charging voltages Vg are applied to the respective chargers 6 for the colors Y, M and C. In a similar way, the output terminal of the AC power circuit 103 is connected to the output terminal of the DC power circuit 101 for the color K, and a charging voltage Vg is generated. The charging voltage Vg is applied to the charger 6 for the color K.

Under each of the photoreceptor drums 5, an exposure device 7 is provided. The exposure device 7 irradiates the photoreceptor drum 5 with a light beam B in accordance with image data at an exposure area immediately downstream from a charging area where the photoreceptor drum 5 is electrified. Accordingly, an electrostatic latent image for the corresponding color is formed.

The developing device 8 supplies the corresponding photoreceptor drum 5 with a developer in the corresponding color at a developing area immediately downstream from the exposure area. Accordingly, a toner image in the corresponding color is formed.

The intermediate transfer belt 3 is stretched around the peripheral surfaces of at least two rollers arranged in the right-left direction, for example. The intermediate transfer belt 3 is rotated, for example, in a direction indicated by arrow β. The peripheral surface of the intermediate transfer belt 3 is, for example, in contact with the upper ends of the photoreceptor drums 5.

The first transfer roller 9 is provided to face the corresponding photoreceptor drum 5 across the intermediate transfer belt 3. The first transfer roller 6 presses the intermediate transfer belt 3 from above such that a first transfer nip 91 is formed between the corresponding photoreceptor drum 5 and the intermediate transfer belt 3. During a printing process, a first transfer bias voltage is applied to the first transfer roller 9, and accordingly, the toner image on the corresponding photoreceptor drum 5 is transferred to the intermediate transfer belt 3 at the corresponding first transfer nip 91 while the intermediate transfer belt 3 is rotating.

The second transfer roller 4 is capable of rotating on its axis. During a printing process, a second transfer bias voltage is applied to the second transfer roller 4. The second transfer roller 4 is located, for example, near the right side of the intermediate transfer belt 3. The second transfer roller 4 presses the outer peripheral surface of the intermediate transfer belt 3 such that a second transfer nip 41 is formed at a contact portion between the second transfer roller 4 and the intermediate transfer belt 3. During the printing process, a print medium M is fed to the second transfer nip 41.

While the print medium M is passing through the second transfer nip 41, the second transfer bias voltage is applied to the second transfer roller 4, and therefore, the toner image carried on the intermediate transfer belt 3 is transferred to the print medium M. After passing through the second transfer nip 41, the print medium M passes through a fixing device of a conventional type and is ejected on a tray as a printed matter.

The controller 11 comprises a ROM 111, a CPU 112 (an example of a processor), an SRAM 113 and an NVRAM 114 (an example of a memory). The CPU 112 carries out various processes by following a control program preliminarily stored in the ROM 111 with using the SRAM 113 as a workspace. This embodiment deals with especially the following four processes: 1) a printing process of printing an image on a print medium M; 2) an image stabilization process of controlling the toner density in accordance with a density of a predetermined pattern image so as to achieve a target value; 3) a forced toner resupply process of resupplying toner forcedly to a developing device; and 4) a TCR adjustment process of controlling the ratio between toner and carrier to achieve a target value. During any one of the four processes, the photoreceptor drums 5 must be electrified, and therefore, the charging voltages Vg are applied to the chargers 6.

Further, the CPU 112 carries out a first charging voltage determination process and a second charging voltage determination process, which will be described later, selectively so as to determine a peak-to-peak voltage Vpp, which is to be used for the four processes above and is to be a reference of an AC voltage Vac as a component of each charging voltage Vg. The peak-to-peak voltage Vpp determined as a reference will hereinafter be referred to as a reference peak-to-peak voltage Vpp0. Additionally, in order to determine a peak-to-peak voltage Vpp of an AC voltage Vac actually applied during the four processes, the CPU 112 stores the total number of rotations of each of the photoreceptor drums 5 as an example of usage conditions Irot in the NVRAM 114 (see Table 2 below). The peak-to-peak voltage Vpp of the actually applied voltage Vac will hereinafter be referred to as an actual peak-to-peak voltage Vpp1. Note that the reference peak-to-peak voltage Vpp0 is different from the actual peak-to-peak voltage Vpp1 in this embodiment, as will be described later.

TABLE 2

| Information on Usage Condition Irot | |
|---|---|
| Color | Total Number of Rotations |
| Y | 200,000 |
| M | 200,000 |
| C | 200,000 |
| K | 400,000 |

Moreover, the CPU 112 stores a reference peak-to-peak voltage Vpp0 and a corrected peak-to-peak voltage Vpp0' that were derived at the previous first charging voltage determination process in the NVRAM 114. The CPU 112 stores the temperature St inside the image forming apparatus 1 at the previous first charging voltage determination process as a previous inside temperature St' (see Table 3 below).

TABLE 3

| Contents of NVRAM 114 | |
|---|---|
| At previous first charging voltage determination process | Reference peak-to-peak voltage Vpp0<br>Corrected peak-to-peak voltage Vpp0'<br>Previous inside temperature St' |

The environmental condition detector 12 includes a temperature sensor 121 and a humidity sensor 122. The temperature sensor 121 detects the temperature inside the image forming apparatus 1 (inside temperature St) and outputs the detection result to the CPU 112. The humidity sensor 122 detects the relative humidity inside the image forming apparatus 1 (inside humidity Sh) and outputs the detection result to the CPU 112.

The amperometric detector 13 detects the value of the alternating current Iac flowing in each of the chargers 6, for example, flowing in the charger 6 for yellow when the charging voltage Vg is applied to the charger 6, and outputs the detection result to the CPU 112.

3. Action of the Image Forming Apparatus

Figure 4:
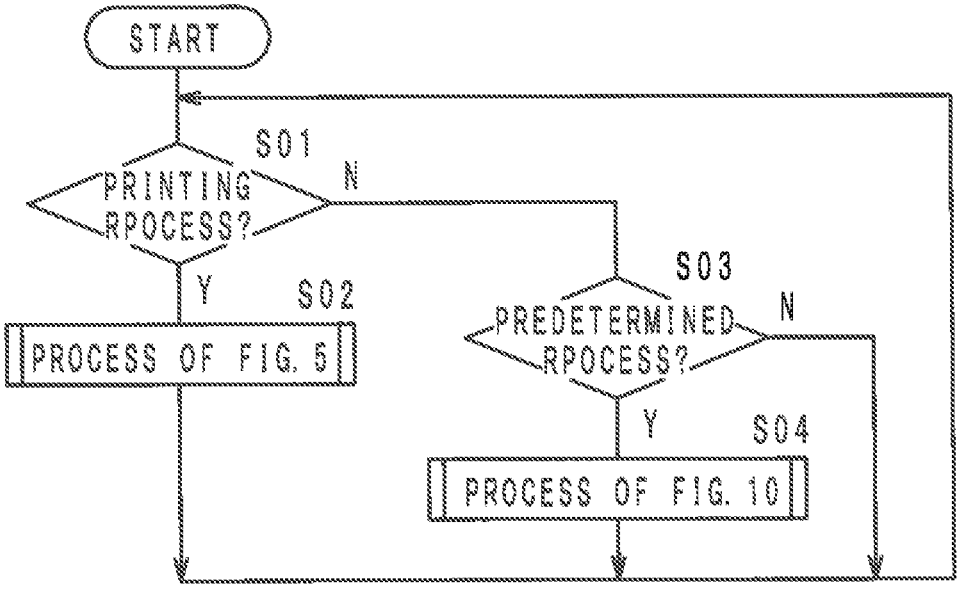
FIG. 4 is a main flowchart indicating a process carried out by a CPU (processing unit) indicated in FIG. 2.
Figure 5:
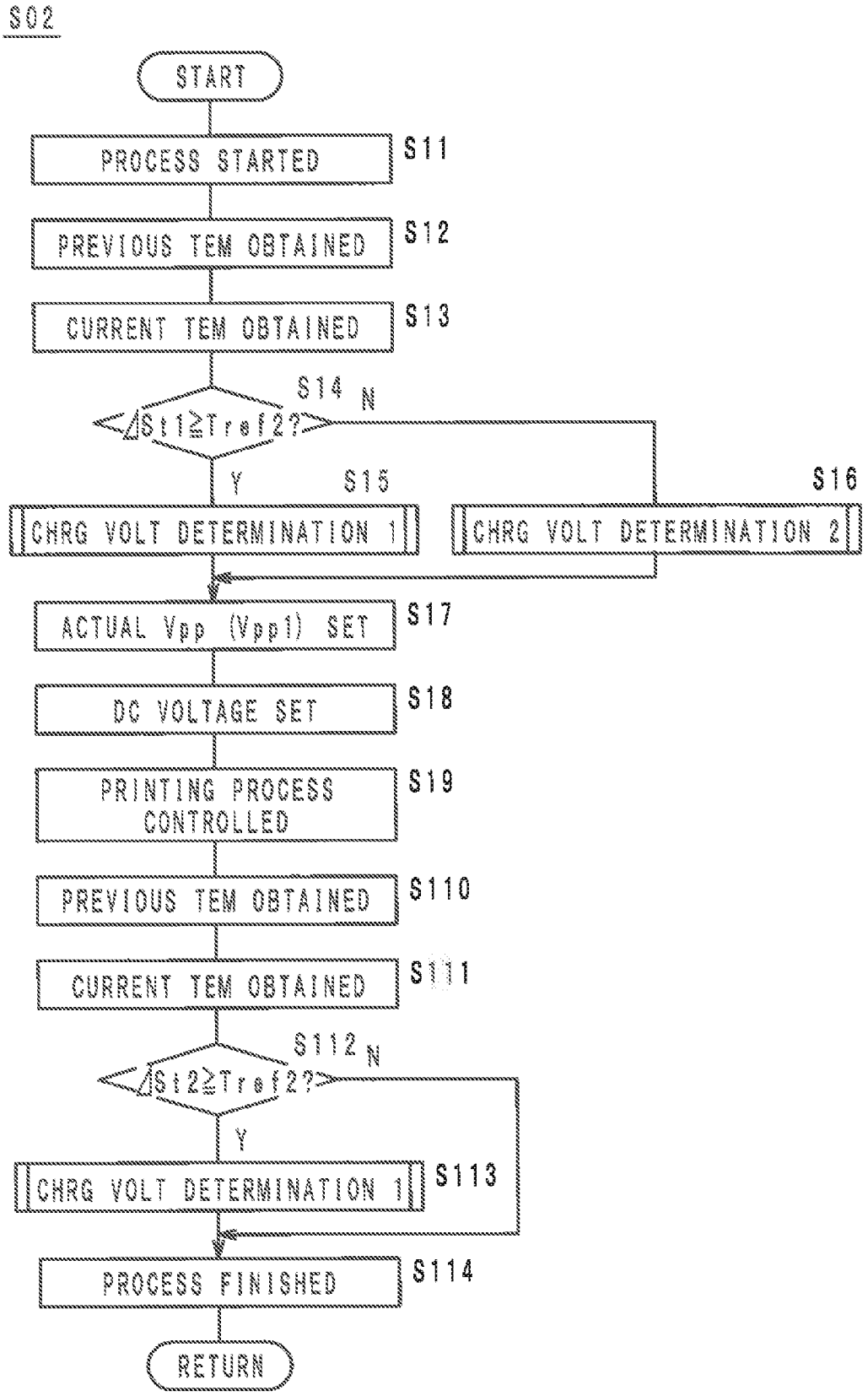
FIG. 5 is a flowchart of a printing process carried out by the CPU.
Figure 8:
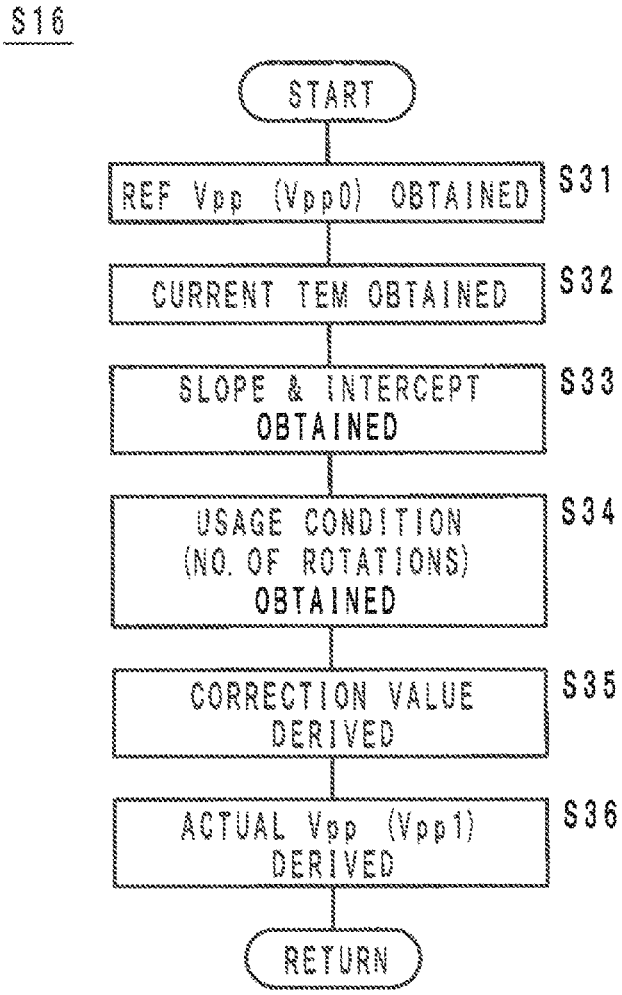
FIG. 8 is a flowchart of a second charging voltage determination process carried out by the CPU.
Figure 9:
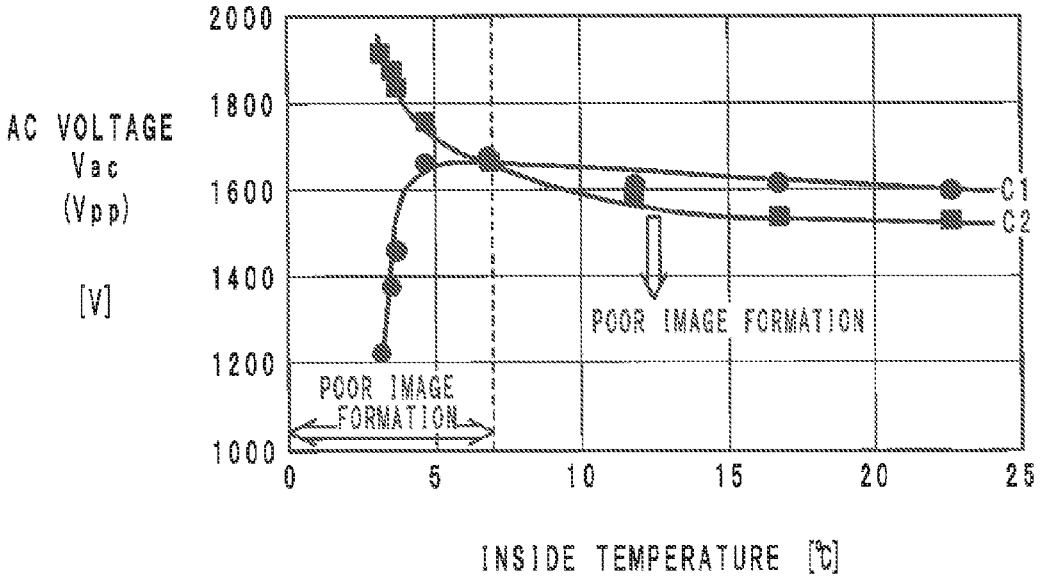
FIG. 9 is a graph showing a reason why a second threshold is set to 10° C.
Figure 10:
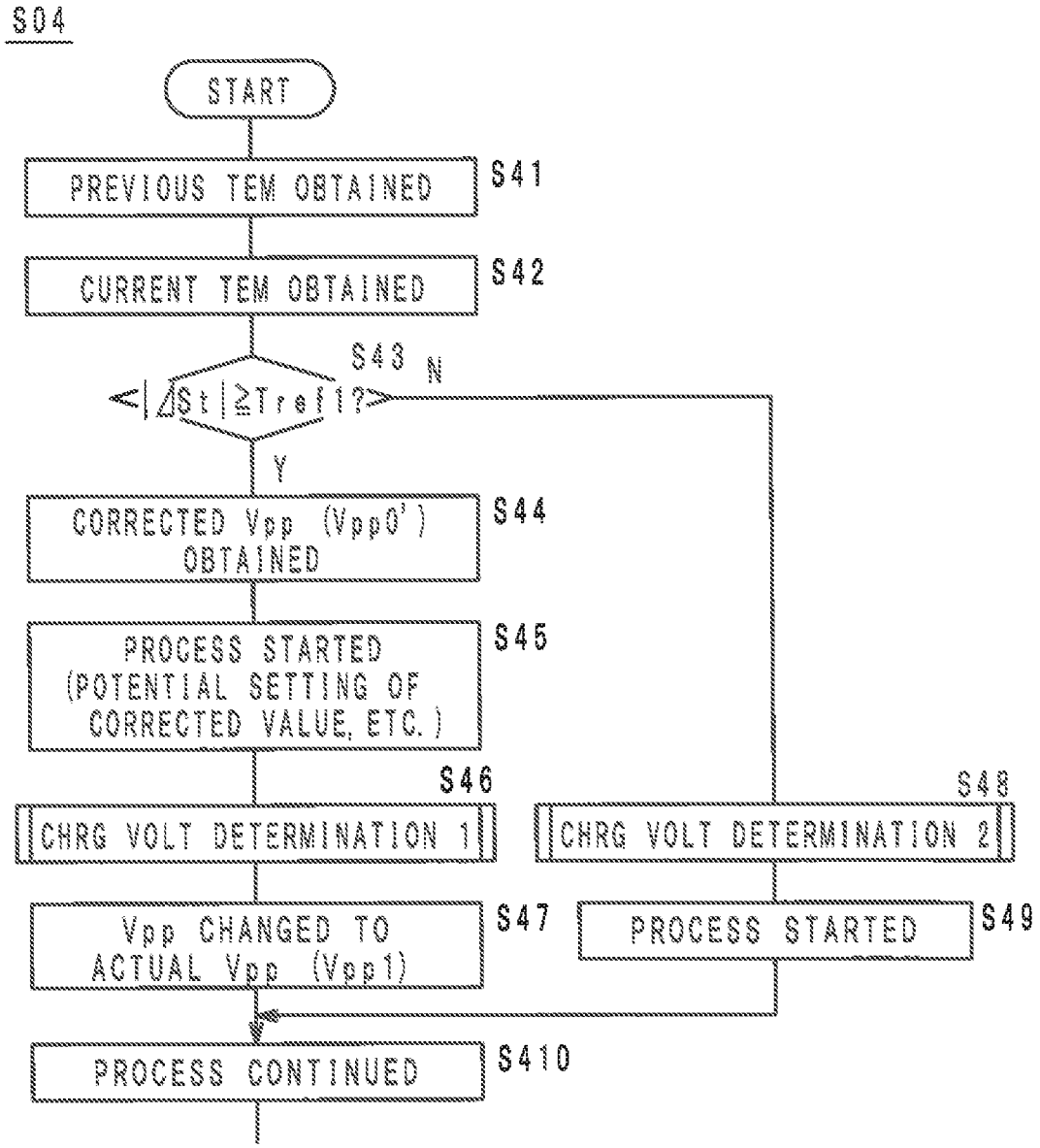
FIG. 10 is a flowchart of a process carried out by the CPU for image stabilization, forced toner resupply, or TCR adjustment.
Figure 11:
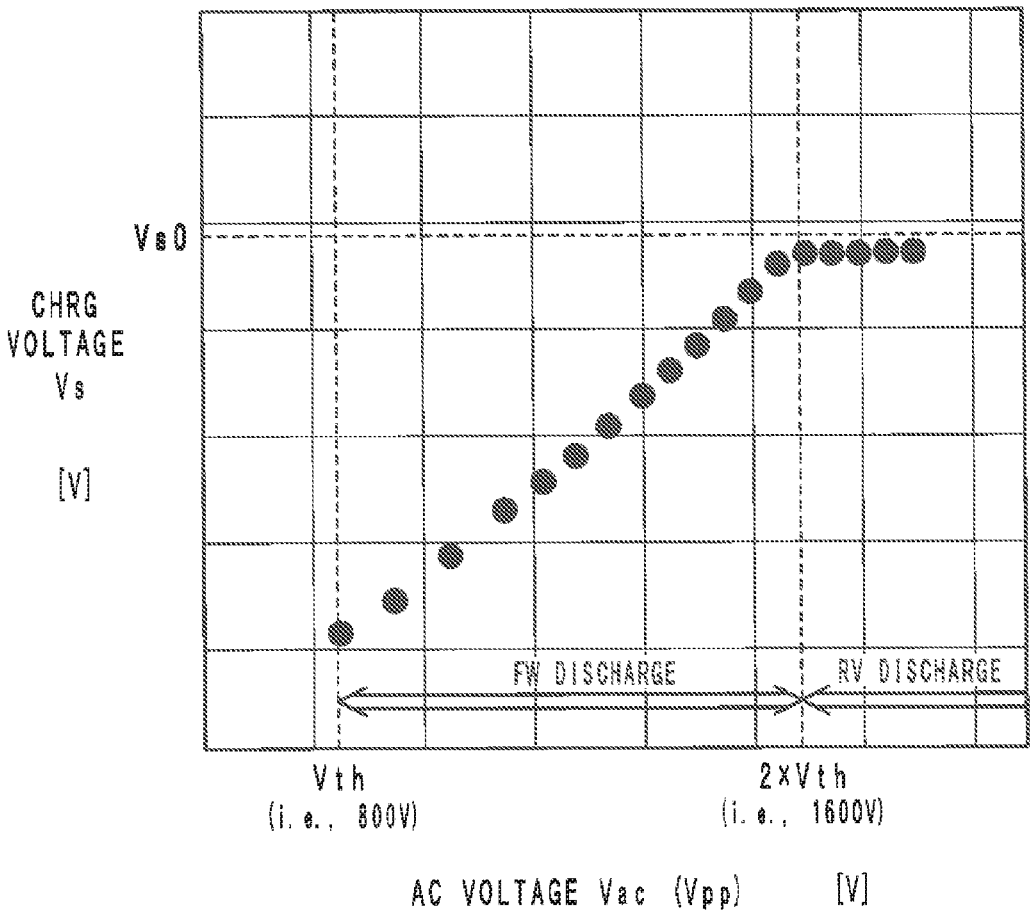
FIG. 11 is a graph indicating a surface potential characteristic of a photoreceptor drum with respect to peak-to-peak voltage.
Figure 12:
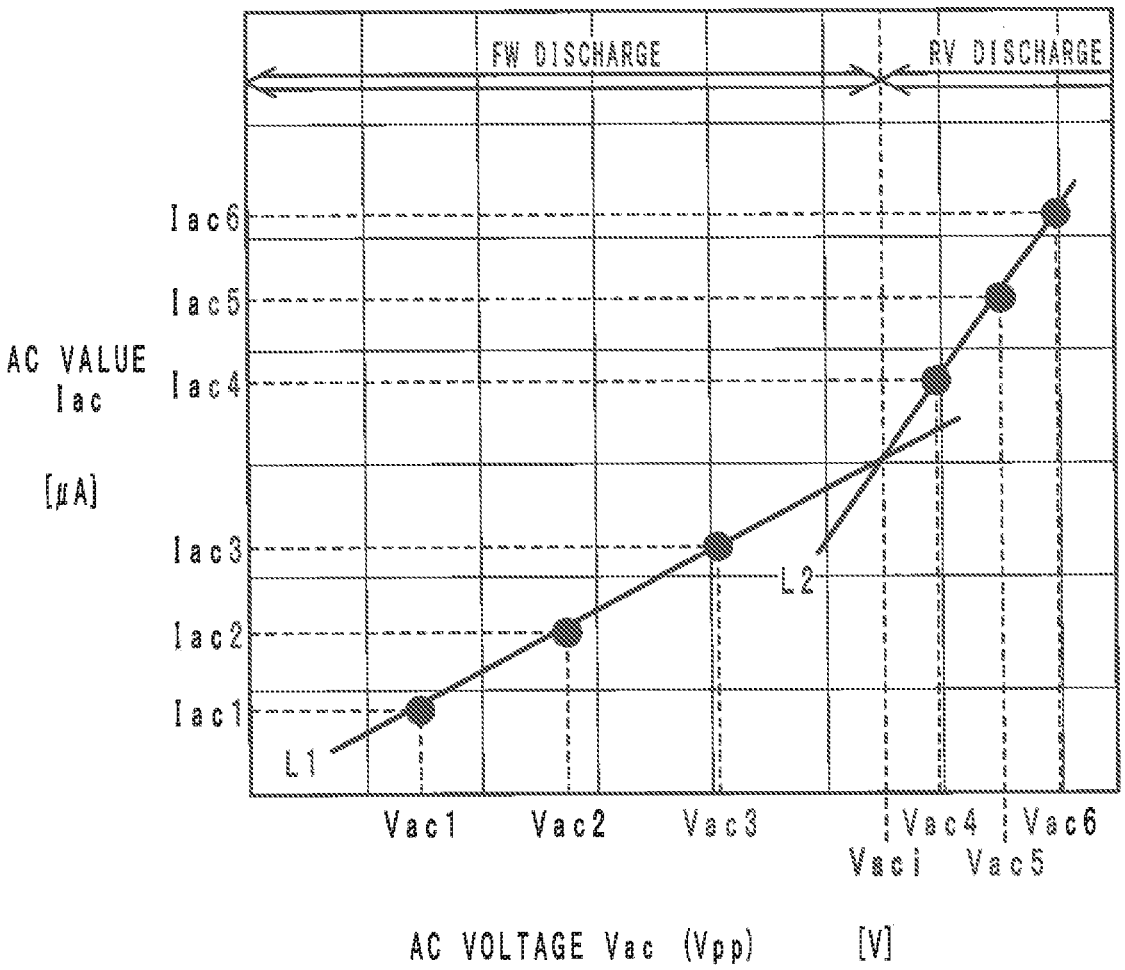
FIG. 12 is a graph indicating a specific example of the first charging voltage determination process.

Next, with reference to FIGS. 4-10, the action of the image forming apparatus 1 is described. Referring to FIG. 4, while the image forming apparatus 1 is operating, the CPU 112 determines whether or not the process which the CPU 112 is on the point of starting is a printing process at a predetermined time (S01). If the CPU 112 makes an affirmative judgement (Y) at S01, the CPU 112 carries out a process as illustrated in FIG. 5 at S02. If the CPU 112 makes a negative judgement (N) at S01, the CPU 112 determines whether or not the process is any one of an image stabilization process, a forced toner resupply process and a TCR adjustment process at S03. If the CPU 112 makes an affirmative judgement at S03, the CPU 112 carries out a process as illustrated in FIG. 10 at SO4. If the CPU 112 makes a negative judgement at S03, the CPU 112 returns to S01.

Referring to FIG. 5, after the start of a print job, the CPU 112 starts a printing process and starts rotating the photoreceptor drums 5 at S11. Then, the CPU 112 obtains the previous inside temperature St' from the NVRAM 114 at S12. Also, the CPU 112 obtains the current inside temperature St at S13. Next, at S14, the CPU 112 subtracts the current inside temperature St from the previous inside temperature St', and determines whether or not the result of the subtraction (difference) ASt1 is equal to or greater than 10° C., which is a typical example of a second threshold Tref2.

If the CPU 112 makes an affirmative judgement at S14, the CPU 112 carries out the first charging voltage determination process at S15 to determine the actual peak-to-peak voltages Vpp1 of AC voltages Vac to be output from the AC power circuits 102 and 103 at S17.

Figure 6:
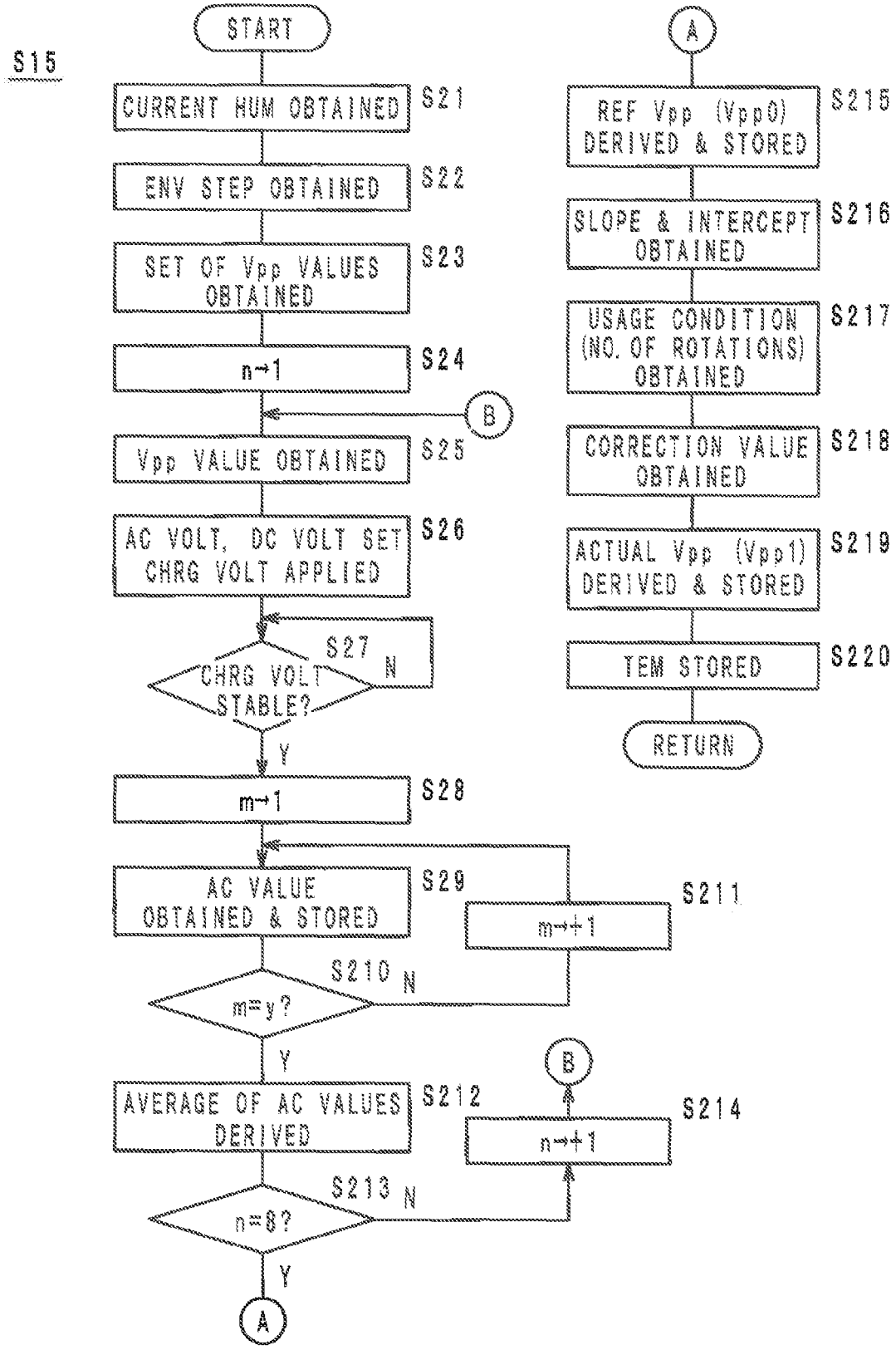
FIG. 6 is a flowchart of a first charging voltage determination process carried out by the CPU.

Now referring to FIG. 6, the first charging voltage determination process is described. At S21, the CPU 112 obtains the current humidity Sh from the humidity sensor 122. At S22, the CPU 112 searches an environment step table T1 preliminarily stored in the ROM 111 or the NVRAM 114 for an environmental step corresponding to the inside temperature St and the inside humidity Sh obtained at steps S13 and S21. As Table 4 below indicates, the table T1 indicates an environment step, which is an index of the absolute humidity, for each combination of inside temperature and inside humidity. In this embodiment, there are 16 environment steps. The environment steps 1-3 mean a low-temperature and low-humidity state (LL state), and the environment steps 4-7 mean a normal-temperature and normal-humidity state (NN state). The environment steps 8-12 mean a little high-temperature and high-humidity state, and the environment steps 13-16 mean a high-temperature and high-humidity state (HH state).

TABLE 4

| Environment Step Table T1 | | | | | | | | |
|---|---|---|---|---|---|---|---|---|
| | | Inside Temperature (° C.) | | | | | | |
| | | <15 | <20 | <24 | <28 | <32 | <44 | 44≥ |
| Inside Humidity (%) | <18 | 1 | 1 | 1 | 2 | 2 | 2 | 2 |
| | <32 | 2 | 2 | 2 | 2 | 3 | 4 | 6 |
| | <55 | 3 | 5 | 5 | 7 | 7 | 8 | 9 |
| | <65 | 4 | 5 | 7 | 7 | 8 | 9 | 10 |
| | <75 | 6 | 6 | 7 | 8 | 9 | 10 | 11 |
| | <85 | 8 | 8 | 9 | 9 | 11 | 12 | 14 |
| | 85≥ | 10 | 11 | 12 | 13 | 14 | 15 | 16 |

Next, at S23, the CPU 112 selects a set of peak-to-peak voltages Vpp in accordance with the environment step obtained at step S22 from a peak-to-peak voltage table T2 preliminarily stored in the NVRAM114 or the like. As Table 5 below indicates, the table T2 indicates several sets of eight peak-to-peak voltages Vpp. In each of the sets, four of the eight peak-to-peak voltages Vpp are for the forward discharge range, and the other four values Vpp are for the reverse discharge range. For example, for the environment steps 1-3, a set A of peak-to-peak voltages Vpp is selected, and the set A includes 600V, 700V, 800V and 900V for the forward discharge range and 1850V, 1950V, 2050V and 2150V for the reverse discharge range. As indicated in Table 5, a set B of peak-to-peak voltages Vpp is assigned to the environment steps 4-7. A set C of peak-to-peak voltages Vpp is assigned to the environment steps 8-12, and a set D of peak-to-peak voltages Vpp is assigned to the environment steps 13-16.

TABLE 5

Peak-to-peak Voltage Table T2

| | | Environment Step | | | |
|---|---|---|---|---|---|
| | n | 1-3 (Set A) | 4-7 (Set B) | 8-12 (Set C) | 13-16 (Set D) |
| Set of peak-to-peak voltages | 1 | 600 | 600 | 600 | 600 |
| | 2 | 700 | 700 | 700 | 700 |
| | 3 | 800 | 800 | 800 | 800 |
| | 4 | 900 | 900 | 900 | 900 |
| | 5 | 1850 | 1800 | 1750 | 1700 |
| | 6 | 1950 | 1900 | 1850 | 1800 |
| | 7 | 2050 | 2000 | 1950 | 1900 |
| | 8 | 2150 | 2100 | 2050 | 2000 |

Next, the CPU 112 resets the first counter, that is, sets the value n of the first counter to 1 at S24, and then, the CPU 112 picks up a peak-to-peak voltage Vpp from the selected set according to the current value n of the first counter at S25.

At S26, the CPU 112 sets the peak-to-peak voltages Vpp of AC voltages Vac to be output from the AC power circuits 102 and 103 to the value selected at S25, and the CPU 112 also sets the DC voltages Vdc to be output from the respective DC power circuits 101 to a predetermined value.

Consequently, charging voltages Vg are applied to the chargers 6 from the power source 10. When the AC voltages Vac output from the AC power circuits 102 and 103 become stable (YES at S27), the CPU 112 resets a second counter, that is, sets the value m of the second counter to 1 at S28. Next, at S29, the CPU 112 obtains the AC value Iac from the amperometric detector 13 and stores the value temporarily in the SRAM 113. Next, at S210, the CPU 112 judges whether or not the value m of the second counter is a number y. The number y is a natural number indicating the number of samples taken during one rotation of each of the photoreceptor drums 5. If the CPU 112 makes a negative judgement at step S210, the CPU 112 increments the second counter value m by one at S211 and executes the step at S29.

While the CPU 112 carries out the process from S28 to S211 above, the AC values Iac at a number y of different points in the rotating direction of each of the photoreceptor drums 5 measured during one rotation of the photoreceptor drum 5 are stored in the SRAM 113. After making an affirmative judgement at S210, the CPU 112 derives the average of the AC values Iac which are y in number at S212. Next, at S213, the CPU 112 judges whether or not the first counter value n is eight, that is, whether or not the process from S25 to S212 has been done with respect to all of the peak-to-peak voltages Vpp included in the set selected at step S23. If the CPU 211 makes a negative judgement at S213, the CPU 112 increments the first counter value n by one at S214 and executes the step at S25.

While the CPU 112 carries out the process from S25 to S213, eight AC values Iac that are obtained by applications of charging voltages Vg to each of the chargers 6 sequentially are stored in the SRAM 113. Each of the eight values indicates a value of alternating current Iac caused to flow in each of the chargers 6 when a charging voltage Vg including an AC voltage Vac having one of the four peak-to-peak voltages Vpp for the forward discharge range or one of the four peak-to-peak voltages Vpp for the reverse discharge range is applied to each of the chargers 6.

At S215, the CPU 112 derives a reference peak-to-peak voltage Vpp0 to be used for a printing process and other processes from the eight AC values Iac stored in the SRAM 113, and stores the reference peak-to-peak voltage Vpp0 in the NVRAM 114 as a previous reference peak-to-peak voltage.

Figure 7:
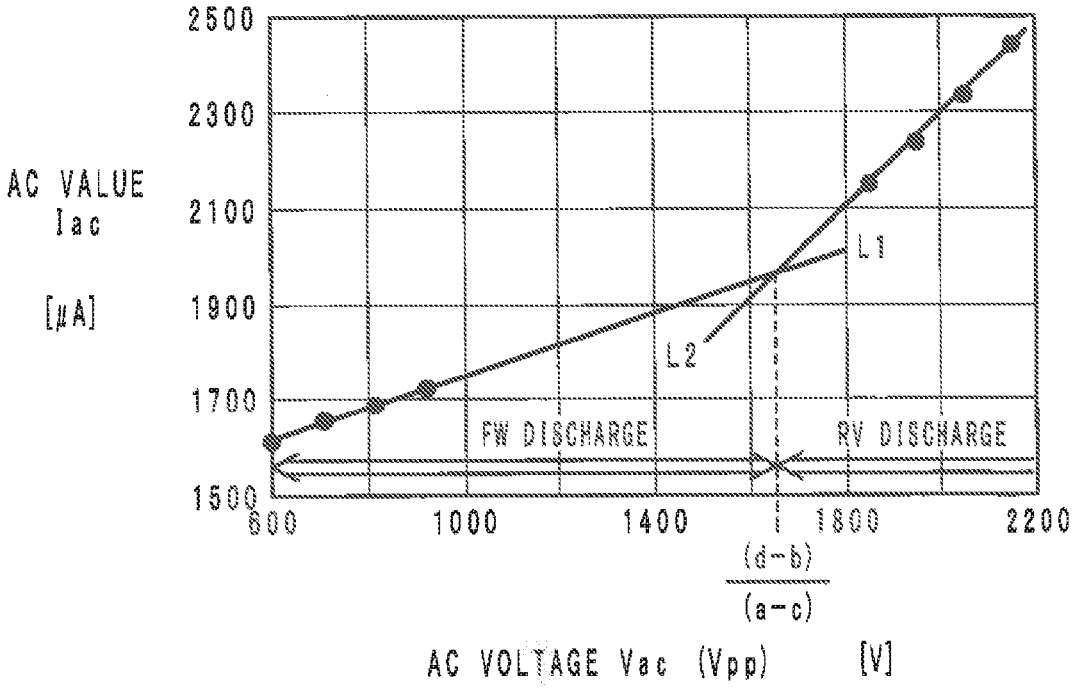
FIG. 7 is a graph indicating the process at step S215 in the flowchart of FIG. 6.

With reference to FIG. 7, the step at S215 is described in detail. The CPU 112 obtains a characteristic line L1 indicating the AC value with respect to the applied AC voltage (Iac=axVac+b) for the forward discharge range by linearly approximating the AC values Iac for the forward discharge range based on the least-square method or the like. In a similar way, the CPU 112 obtains a characteristic line L2 indicating the AC value with respect to the applied AC voltage (Iac=cxVac+d) for the reverse discharge range by linearly approximating the AC values Iac for the reverse discharge range based on the least-square method or the like. The values a, b, c and d are constants. Specifically, the values a and c are slopes, and the values b and d are intercepts. Thereafter, the CPU 112 derives the AC voltage value Vac at the point of intersection between the characteristic lines L1 and L2 (that is, (d-b)/(a-c)) as a reference peak-to-peak voltage Vpp0, and stores the reference peak-to-peak voltage Vpp0 in the NVRAM 114 as a value determined by the previous first charging voltage determination process (see Table 3).

With reference to FIG. 6 again, the steps after S215 are described. The reference peak-to-peak voltage Vpp0 stored at S215 is a value in accordance with the environment step, and the value Vpp0 is far from an accurate value that suites the current environmental conditions. Therefore, at S216, the CPU 112 selects one combination of a slope and an intercept from the correction table T3 preliminarily stored in the NVRAM 114 or the like in accordance with the inside temperature St and the inside humidity Sh obtained at S13 and S21. In the correction table T3, a combination of a slope and an intercept is given for each combination of a temperature range and a humidity range, as indicated in Table 6 below. For example, the combination of a slope and an intercept for the conditions of Sh (inside humidity)<20% and 10.5° C.≤St (inside temperature)<12.5° C. is a combination of −0.054 and 269.

TABLE 6

Relative Humidity Sh < 20%

| | | | | | | |
|---|---|---|---|---|---|---|
| Temperature | ≤ | | 10.5 | 12.5 | 14.5 | 16.5 |
| St | < | 10.5 | 12.5 | 14.5 | 16.5 | 18.5 |
| Slope | | −0.0054 | −0.0054 | −0.0054 | −0.0054 | −0.0054 |
| Intercept | | 273 | 269 | 254 | 242 | 232 |
| | | | 18.5 | 20.5 | 22.5 | 24.5 |
| | | | 20.5 | 22.5 | 24.5 | 26.5 |

TABLE 6-continued

| | | | | | | |
|---|---|---|---|---|---|---|
| | | | −0.0054 | −0.0054 | −0.0054 | −0.0054 |
| | | | 222 | 214 | 206 | 199 |
| | | | | 26.5 | 28.5 | 30.5 |
| | | | | 28.5 | 30.5 | |
| | | | | −0.0054 | −0.0054 | −0.0054 |
| | | | | 193 | 187 | 181 |
| 20% ≤ Relative Humidity Sh < 50% | | | | | | |
| Temperature | ≤ | | 10.5 | 12.5 | 14.5 | 16.5 |
| St | < | 10.5 | 12.5 | 14.5 | 16.5 | 18.5 |
| Slope | | −0.0054 | −0.0054 | −0.0054 | −0.0054 | −0.0054 |
| Intercept | | 255 | 243 | 236 | 227 | 219 |
| | | | 18.5 | 20.5 | 22.5 | 24.5 |
| | | | 20.5 | 22.5 | 24.5 | 26.5 |
| | | | −0.0054 | −0.0054 | −0.0054 | −0.0054 |
| | | | 216 | 209 | 203 | 198 |
| | | | | 26.5 | 28.5 | 30.5 |
| | | | | 28.5 | 30.5 | |
| | | | | −0.0054 | −0.0054 | −0.0054 |
| | | | | 193 | 188 | 184 |
| 50% ≤ Relative Humidity Sh < 80% | | | | | | |
| Temperature | ≤ | | 10.5 | 12.5 | 14.5 | 16.5 |
| St | < | 10.5 | 12.5 | 14.5 | 16.5 | 18.5 |
| Slope | | −0.0054 | −0.0054 | −0.0054 | −0.0054 | −0.0054 |
| Intercept | | 220 | 215 | 212 | 208 | 205 |
| | | | 18.5 | 20.5 | 22.5 | 24.5 |
| | | | 20.5 | 22.5 | 24.5 | 26.5 |
| | | | −0.0054 | −0.0054 | −0.0054 | −0.0054 |
| | | | 203 | 200 | 198 | 196 |
| | | | | 26.5 | 28.5 | 30.5 |
| | | | | 28.5 | 30.5 | |
| | | | | −0.0054 | −0.0054 | −0.0054 |
| | | | | 193 | 192 | 190 |
| Relative Humidity Sh > 80% | | | | | | |
| Temperature | ≤ | | 10.5 | 12.5 | 14.5 | 16.5 |
| St | < | 10.5 | 12.5 | 14.5 | 16.5 | 18.5 |
| Slope | | −0.0054 | −0.0054 | −0.0054 | −0.0054 | −0.0054 |
| Intercept | | 220 | 215 | 212 | 208 | 205 |
| | | | 18.5 | 20.5 | 22.5 | 24.5 |
| | | | 20.5 | 22.5 | 24.5 | 26.5 |
| | | | −0.0054 | −0.0054 | −0.0054 | −0.0054 |
| | | | 203 | 200 | 198 | 196 |
| | | | | 26.5 | 28.5 | 30.5 |
| | | | | 28.5 | 30.5 | |
| | | | | −0.0054 | −0.0054 | −0.0054 |
| | | | | 193 | 192 | 190 |

Next, at S217, the CPU 112 obtains the number of rotations of the photoreceptor drum 5 for yellow from the usage condition information Irot stored in the NVRAM 114. Then, at S218, the CPU 112 derives a correction value as follows.

$$\text{Correction Value}=\text{Slope}\times\text{Number of Rotations}+\text{Intercept} \quad (1)$$

At S219, for each of the colors, the CPU 112 derives an actual peak-to-peak voltage Vpp1 accurately suited for the current environmental conditions (temperature and relative humidity) by adding a correction value to the reference peak-to-peak voltage Vpp0 derived at step S215, and stores the actual peak-to-peak voltage Vpp1 in the NVRAM 114 as a corrected value Vpp0' of the reference peak-to-peak voltage Vpp0 determined by the previous first charging voltage determination process (see Table 3). Next, at S220, the CPU 112 stores the inside temperature St obtained at S13 in the NVRAM 114 as a value determined by the previous first charging voltage determination process (see Table 3), and the process illustrated in FIG. 6 is finished.

With reference to FIG. 5 again, at S14, the CPU 112 judges whether or not the temperature difference ΔSt1 is equal to or greater than the second threshold Tref2 (10° C.). If the CPU 112 makes a negative judgement at S14, the CPU 112 carries out a second charging determination process at S16 to determine an actual peak-to-peak voltage Vpp1 of the AC voltages Vac to be output from the AC power circuits 102 and 103 at S17.

Now with reference to FIG. 8, the second charging voltage determination process is described. At S31 in FIG. 8, the CPU 112 obtains the reference peak-to-peak voltage Vpp0 determined by the previous first charging voltage determination process from the NVRAM 114 (see Table 3).

Next, at S32, the CPU 112 obtains the current inside humidity Sh from the humidity sensor 122. Thereafter, at S33 to S35, the CPU 112 derives a correction value by executing a process similar to the process from S216 to S218.

Next, at S36, the CPU 112 derives an actual peak-to-peak voltage Vpp1 accurately suited for the current environmental conditions by adding the correction value to the reference peak-to-peak voltage Vpp0 obtained at S31, and the process indicated in FIG. 8 is finished. Thus, this second charging voltage determination process does not require execution of the step at S215 that requires a large volume of operation (see FIG. 7). Therefore, by the second charging voltage determination process, the actual peak-to-peak voltage Vpp1 can be derived shortly, as compared to the first charging voltage determination process.

With reference to FIG. 5 again, at step S17 after step S15 or S16, the CPU 112 sets the peak-to-peak voltage Vpp of the AC voltages Vac to be output from the AC power circuits 102 and 103 to the actual peak-to-peak voltage Vpp1 obtained at S15 or S16. At S18, the CPU 112 sets the DC voltages Vdc to be output from the DC power circuits 101 to a predetermined value.

Thereafter, at S19, the CPU 112 controls the printing process described in the Section 2 above. After S19, the CPU 112 obtains the previous inside temperature St' from the NVRAM114 at S110 and obtains the current inside temperature St from the temperature sensor 121 at S111. Next, at S112, the CPU 112 subtracts the previous inside temperature St' from the current inside temperature St, and judges whether or not the difference (that is, the temperature change) ΔSt2 is not less than 10° C., which is a typical example of the second threshold Tref2.

If the CPU 112 makes an affirmative judgement at S112, at S113, the CPU 112 carries out a first charging voltage determination process similar to the process carried out at S15. The process at S113, however, differs from the process at S15 in the following point. What is done at S113 is only storing the reference peak-to-peak voltage Vpp0, the corrected peak-to-peak voltage Vpp0' and the inside temperature St obtained at S111 in the NVRAM114 as values determined by the previous first charging voltage determination process. Accordingly, the reference peak-to-peak voltage Vpp0 and the corrected peak-to-peak voltage Vpp0' are not used as the actual peak-to-peak voltage Vpp1 for the current printing process. The purpose of storing the reference peak-to-peak voltage Vpp0, the corrected peak-to-peak voltage Vpp0' and the inside temperature St at S113 is to use these values for a process (a printing process, an image stabilization process or the like) to be carried out next to the current printing process. As described above, there are cases in which the reference peak-to-peak voltage Vpp0 is only stored in the NVRAM 114 and is not set in the AC power circuits 102 and 103 during the current process. However, the actual peak-to-peak voltage Vpp1 is set in the AC power circuits 102 and 103 during the current process. The reference peak-to-peak voltage Vpp0 is different from the actual peak-to-peak voltage Vpp1 in this point.

When the CPU 112 makes a negative judgement at S112 or after the CPU 112 carries out the process at S113, at S114, the CPU 112 finishes the printing process, for example, by stopping the application of the charging voltages Vg, stopping the photoreceptor drums 5, etc., and then, the process illustrated in FIG. 5 is completed.

Next, with reference to FIG. 9, the reason why the second threshold Trf2 indicated in FIG. 5 is set to 10° C. is described. FIG. 9 shows characteristic lines C1 and C2. The characteristic line C1 indicates a peak-to-peak voltage Vpp derived by the first charging voltage determination process with reference to the inside temperature. The characteristic curve C2 indicates the lower limit of the peak-to-peak voltage Vpp that does not cause poor image formation on a printed medium. The inventors found out by experiment that within a temperature range where the characteristic line C1 is lower than the characteristic line C2, poor image formation occurs on a print medium due to poor charging.

Also, in the range where the inside temperature is equal to or higher than 10° C., with reference to the characteristic line C2, the lower limit of the peak-to-peak voltage Vpp that does not cause poor image formation changes by about 50V with a change in the inside temperature of about 10° C. The inventors found out by experiment that a change in the AC voltage Vac of about 50V causes poor image formation on a print medium.

Therefore, if the change in inside temperature since the previous time of first charging voltage determination process is 10° C. or more, it is necessary to carry out the first charging voltage determination process again to derive an AC voltage Vac (with a peak-to-peak voltage Vpp) appropriate for the current inside temperature. If the temperature change is less than 10° C., on the other hand, it is not necessary to carry out the first charging voltage determination process again. Specifically, the inventors found out by experiment that in this case, using the AC voltage Vac (with a peak-to-peak voltage Vpp) derived by adding the correction value to the reference peak-to-peak voltage, both of the values determined and stored by the previous first charging voltage process, does not cause poor image formation on a print medium. Also, by not carrying out the first charging voltage process in a case in which the change in inside temperature is less than 10° C., it is possible to shorten the time from the start to the end of a printing process.

As thus far described, if the AC voltage Vac of the charging voltage Vg is too low, poor image formation on a print medium results (see the characteristic line C2 in FIG. 9). On the other hand, if the AC voltage Vac of the charging voltage Vg is too high, abrasion of the photoreceptor drum 5 is promoted. As is clear from the characteristic line C2 in FIG. 9, as the inside temperature is getting lower, the AC voltage Vac must be set relatively higher, and as the inside temperature is getting higher, the AC voltage Vac must be set relatively lower. In a case in which the change in inside temperature is 10° C. or more, the lower limit of the peak-to-peak voltage Vpp that does not cause poor image formation changes by about 50V, and consequently, poor image formation on a print medium may result.

Suppose that the CPU 112 carries out the second charging voltage determination process to determine the actual peak-to-peak voltage Vpp1 by use of the reference peak-to-peak voltage Vpp0 stored in the NVRAM 114 in a case in which the inside temperature at the current printing process is different from the inside temperature at the previous first charging determination process by 10° C. or more. In this case, the determined actual peak-to-peak voltage Vpp1 is lower than an AC voltage Vac appropriate for the current temperature at the current printing process, and there is a high possibility of poor image formation on a print medium.

Also, suppose that the CPU 112 carries out the second charging voltage determination process in a case in which the inside temperature has risen by 10° C. or more. In this case, the determined actual peak-to-peak voltage Vpp1 is higher than an AC voltage Vac appropriate for the current temperature at the current printing process, and there is a high possibility of too much acceleration of abrasion of the photoreceptor drum 5.

For the reasons above, the second threshold Tref2 used at step S14 is set to 10° C. If the temperature difference ΔSt1 is judged to be equal to or greater than 10° C. at S14, the CPU 112 carries out the first charging voltage determination process, and if the temperature difference ΔSt1 is judged to be less than 10° C. at S14, the CPU 112 carries out the second charging voltage determination process giving priority to shortening of the user's waiting time.

Further, if the temperature is judged to have risen by 10° C. or more at S14, the first charging voltage determination process may be carried out in order to prevent too much acceleration of abrasion of the photoreceptor drum 5. According to this embodiment, however, the CPU 112 carries out the second charging voltage determination process in this case giving priority to shortening of the user's waiting time because the possibility of poor image formation is low in this case.

With reference to FIG. 4 again, when the CPU 112 makes an affirmative judgement at S03, the CPU 112 carries out a process illustrated in FIG. 10.

With reference to FIG. 10, when the CPU 112 starts an image stabilization process, a forced toner resupply process or a TCR adjustment process, the CPU 112 obtains the previous inside temperature St' and the current inside temperature St at S41 and S42 in the same way as the steps at S12 and S13. Next, at S43, the CPU 112 judges whether or not the absolute value of the difference |ΔSt| is equal to or greater than 10° C., which is a typical example of the first threshold Tref1. During an image stabilization process or the like, image formation is carried out although no sheets are fed, and therefore, the first threshold Tref1 is preferably equal to the second threshold Tref2, that is, 10° C. However, the first threshold Tref1 may be different from the second threshold Tref2.

If the CPU 112 makes an affirmative judgement at S43, the CPU 112 obtains the corrected peak-to-peak voltage Vpp0' from the NVRAM 114 at S44 for shortening of the user's waiting time. Thereafter, the CPU 112 starts the process at S45. Specifically, the CPU 112 starts the photoreceptor drums 5. Then, when the rotations of the photoreceptor drums 5 become stable, the CPU 112 temporarily sets the peak-to-peak voltages Vpp of the AC voltages Vac to be output from the AC power circuits 102 and 103 to the corrected peak-to-peak voltage Vpp0' obtained at S44, and the CPU 112 sets the DC voltages Vdc to be output from the DC power circuits 101 to a predetermined value. Thereby, the power source 10 applies charging voltages Vg to the chargers 6, and the photoreceptor drums 5 are charged.

Next, at S46, the CPU 112 carries out the first charging voltage determination process (see FIG. 6) to determine the actual peak-to-peak voltages Vpp1 of the AC voltages Vac to be output at S47. Next, at S47, the CPU 112 changes the set values of the peak-to-peak voltages Vpp of the AC voltages Vac to be output from the AC power circuits 102 and 103 to the actual peak-to-peak voltages Vpp1 determined at S46.

On the other hand, if the CPU 112 makes a negative judgement at S43, the CPU 112 carries out the second charging voltage determination process (see FIG. 8) at S48 to determine the actual peak-to-peak voltages Vpp1 of the AC voltages Vac to be output at S49. The time required for the second charging voltage determination process is much shorter than the time required for the first charging voltage determination process. Therefore, it is not necessary to temporarily set the AC voltages Vac before the second charging voltage determination process.

Then, the CPU 112 starts the process at step S49. Specifically, the CPU 112 starts the photoreceptor drums 5. Then, when the rotations of the photoreceptor drums 5 become stable, the CPU 112 sets the peak-to-peak voltages Vpp of the AC voltages Vac to be output from the AC power circuits 102 and 103 to the actual peak-to-peak voltages Vpp1 obtained at S48, and the CPU sets the DC voltages Vdc to be output from the DC power circuits 101 to a predetermined value. Thereby, charging of the photoreceptor drums 5 is started.

After S47 or S49, the CPU 112 executes the processing necessary for the process (image stabilization process, forced toner resupply process or TCR adjustment process) at S410.

4. Operation and Effects of the Image Forming Apparatus

In the image forming apparatus 1 according to this embodiment, the first charging voltage determination process or the second charging voltage determination process is carried out selectively in accordance with the difference ΔSt between the previous inside temperature St' and the current inside temperature St. In the first charging voltage determination process, at least a reference peak-to-peak voltage Vpp0 to be used in processes requiring driving of the photoreceptor drums 5 (for example, a printing process, an image stabilization process, etc.) is derived based on AC values Iac detected by the amperometric detector 13. Specifically, at S15 in FIG. 5, at least a reference peak-to-peak voltage Vpp0 to serve as a base for derivation of an actual peak-to-peak voltage Vpp1 in the current printing process is derived and stored in the NVRAM 114. At S113 in FIG. 5, at least a reference peak-to-peak voltage Vpp0 to be used in the next process is derived and stored in the NVRAM 114. At S46 in FIG. 10, at least a reference peak-to-peak voltage Vpp0 to be used in the current process (except for a printing process) is derived and stored in the NVRAM 114. On the other hand, in the second charging voltage determination process, as has been described in connection with S16 in FIG. 15 and S48 in FIG. 10, an actual peak-to-peak voltage Vpp1 is derived from the reference peak-to-peak voltage Vpp0 determined by the previous first charging voltage determination process and stored in the NVRAM 114. In this way, according to the difference ΔSt, it is possible to derive the peak-to-peak voltage Vpp of the AC voltage Vac to be applied as a component of the charging voltage Vg without carrying out the first charging voltage determination process that requires a large volume of operation. Consequently, it is possible to complete various processes speedily. Thus, the image forming apparatus 1 can shorten the user's waiting time.

In the second charging voltage determination process, at steps S31-35 in FIG. 8, the CPU 112 derives a correction value based on the current environmental conditions (inside temperature St and inside humidity Sh) and the usage condition of the photoreceptor drum 5 (for example, the number of rotations of the photoreceptor drum 5). Thereafter, at S36, the CPU 112 makes a correction to the reference peak-to-peak voltage Vpp0 obtained in the previous first charging voltage determination process to derive an actual peak-to-peak voltage Vpp1 appropriate for the current environmental conditions and the usage condition of the photoreceptor drum 5. In the description above, the environmental conditions are the temperature and the relative humidity inside the image forming apparatus 1. However, if the environmental condition detector 12 includes an absolute humidity sensor, the CPU 112 may select a combination of a slope and an intercept from the correction table T3 (see Table 6) based on the absolute humidity to derive the correction value.

In the first charging voltage determination process, at S216-S218 in FIG. 6, the CPU 112 derive a correction value based on the current environmental conditions and the usage condition of the photoreceptor drum 5. Thereafter, at S219, the CPU 112 makes a correction to the reference peak-to-peak voltage Vpp0 obtained in the current first charging voltage determination process to derive an actual peak-to-peak voltage Vpp1 appropriate for the current environmental conditions and the usage condition of the photoreceptor drum 5.

If the absolute value of the difference |ΔSt| is equal to or greater than a first threshold Tref1, the CPU 112 carries out the first charging voltage determination process, and if not, the CPU 112 carries out the second charging voltage determination process. As is clear from the description with reference to FIG. 9, while the inside temperature St is equal to or higher than 10° C., with a great change in the inside temperature St, the lower limit of the peak-to-peak voltage Vpp that does not cause poor image formation changes by about 50V. Accordingly, in a case in which the inside temperature at the current process is different from the inside temperature at the previous first charging voltage determination process by 10° C. or more, using the reference peak-to-peak voltage Vpp0 determined by the previous first charging voltage determination process in the current process may result in poor image formation on a print medium. For this reason, in a case in which the inside temperature has changed by the first threshold Tref 1 or more since the previous first charging voltage determination process, the CPU 112 carries out the first charging voltage determination process again to derive an AC voltage Vac (with a peak-to-peak voltage Vpp) appropriate for the current inside temperature.

On the other hand, in a case in which the temperature change is less than 10° C., poor image formation is not likely to occur in the current process. In this case, therefore, the CPU 112 derives an actual peak-to-peak voltage Vpp1 from the previously determined reference peak-to-peak voltage Vpp0 without carrying out the first charging voltage determination process that requires a large volume of operation. Hence, it is possible to shorten the user's waiting time in various processes.

Especially in a printing process, as has been described with reference to FIG. 9, in a case in which the inside temperature at the current printing process is different from the inside temperature at the previous first charging voltage determination process by a second threshold Tref2 or more, the CPU 112 carries out the first charging voltage determination process, thereby preventing poor image formation on a print medium and too much acceleration of abrasion of the photoreceptor drums 5.

On the other hand, in a case in which the temperature difference ASO is less than the second threshold Tref2 at S14, the CPU 112 carries out the second charging voltage determination process, thereby shortening the user's waiting time.

5. Supplemental Remarks

According to the description above, the amperometric detector 13 is provided at the charger 6 for yellow. However, as long as the power source 10 includes AC power circuits 102 and 103, the amperometric detector 13 may be provided at any one of the chargers 6.

Also, the image forming apparatus 1 may have two amperometric detectors 13. In this case, one of the amperometric detectors 13 may be provided at any one of the chargers 6 for yellow, magenta and cyan, and the other amperometric detector 13 may be provided at the charger 6 for black. In this case, the CPU 112 may derive a peak-to-peak voltage Vpp of an AC voltage to be output from the AC power circuit 102 for yellow, magenta and cyan and derive a peak-to-peak voltage VPP of an AC voltage to be output from the AC power circuit 103 for black.

According to the description above, the power source 10 includes an AC power circuit 102 for yellow, magenta and cyan, and an AC power circuit 103 for black. However, the power source 10 may include AC power circuits used for yellow, magenta, cyan and black, respectively. In this case, the image forming apparatus 1 may have four amperometric detectors 13, and the CPU 112 may derive peak-to-peak voltages Vpp of AC voltages to be output from the respective AC power circuits.

Although the present invention has been described in connection with the preferred embodiment above, it is to be noted that various changes and modifications may be obvious to those who are skilled in the art. Such changes and modifications are to be understood as being within the scope of the invention.

What is claimed is:

1. An image forming apparatus capable of forming an image on a print medium while feeding the print medium, the image forming apparatus comprising:

an image supporting member;

a charger provided in proximity to the image supporting member;

a power source unit configured to apply a plurality of charging voltages to the charger sequentially while no print medium is fed, the charging voltages including alternating voltages having different peak-to-peak voltages, respectively;

an amperometric detector configured to detect values of the alternating currents flowing in the charger during application of the plurality of charging voltages; and a processor configured to carry out a first charging voltage determination process to determine a peak-to-peak voltage to be used in a process, or a second charging voltage determination process to determine a peak-to-peak voltage to be used in the process selectively based on a detection result of the amperometric detector, the second charging voltage determination process requiring a shorter time to determine the peak-to-peak voltage than the first charging voltage determination process, wherein the processor carries out the first charging voltage determination process or the second charging voltage determination process selectively in accordance with a difference between an ambient temperature at a previous time of carrying out the first charging voltage determination process and a current ambient temperature.

2. The image forming apparatus according to claim 1, wherein in the second charging voltage determination process, the processor derives a peak-to-peak voltage to be used in the process by correcting the peak-to-peak voltage determined by the previous first charging voltage determination process based on a current environmental condition and a usage condition of the image supporting member.

3. The image forming apparatus according to claim 2, wherein the environmental condition is at least one of a temperature, a relative humidity and an absolute humidity.

4. The image forming apparatus according to claim 1, wherein in the first charging voltage determination process, the processor corrects a derived peak-to-peak voltage based on a current environmental condition and a usage condition of the image supporting member.

5. The image forming apparatus according to claim 1, wherein the processor carries out the first charging voltage determination process in a case in which the difference is equal to or greater than a predetermined first threshold and carries out the second charging voltage determination process in a case in which the difference is smaller than the first threshold.

6. The image forming apparatus according to claim 1, wherein:

an alternating voltage range in which charge transfers only from the charger to the image supporting member is referred to as a forward discharge range, and an alternating voltage range in which charge transfers from the charger to the image supporting member and from the image supporting member to the charger alternately is referred to as a reverse discharge range;

the power source unit applies a plurality of charging voltages to the charger sequentially while no print medium is fed, the charging voltages including alternating voltages having different peak-to-peak voltages for the forward discharge range and alternating voltages having different peak-to-peak voltages for the reverse discharge range, respectively; and the processor derives a point of intersection between a characteristic line indicating alternating current values with respect to alternating voltages in the forward discharge range and a characteristic line indicating alternating current values with respect to alternating voltages in the reverse discharge range as a peak-to-peak voltage to be used in the process.

7. The image forming apparatus according to claim 1, wherein:

in a case in which the process is a printing process, if the processor judges that the current ambient temperature is lower than the ambient temperature at the previous time of carrying out the first charging voltage determination process by a second threshold or more, the processor carries out the first charging voltage determination process; and after the printing process, if the processor judges that the current ambient temperature is higher than the ambient temperature at the previous time of carrying out the first charging voltage determination process by the second threshold, the processor carries out the first charging voltage determination process.

* * * * *